United States Patent [19]

Anderson

[11] 4,008,522

[45] Feb. 22, 1977

[54] CHALKBOARD LINE TOOL

[76] Inventor: Gordon W. Anderson, 905 Canosa, Las Vegas, Nev. 89105

[22] Filed: Aug. 18, 1975

[21] Appl. No.: 605,678

[52] U.S. Cl. ..... 33/44; 33/41 D

[51] Int. Cl.[2] ..... B43L 13/02

[58] Field of Search ..... 33/32 R, 41 R, 41 D, 33/42, 44

[56] References Cited

UNITED STATES PATENTS

| | | | |
|---|---|---|---|
| 561,585 | 6/1896 | Harris | 33/44 |
| 844,243 | 2/1907 | Breul | 33/42 |
| 858,254 | 6/1907 | Benedict | 33/41 D |
| 1,841,972 | 1/1932 | Mosley | 33/42 |
| 2,861,343 | 11/1958 | Click | 33/41 R |

*Primary Examiner*—Charles E. Phillips
*Attorney, Agent, or Firm*—William J. Bethurum

[57] ABSTRACT

Disclosed is a novel ruler apparatus useful for the rapid and precise marking of a plurality of parallel horizontal lines on a classroom blackboard or the like. This ruler, or line tool to which it is sometimes referred, includes, among other elements, an adjustable staff member which is slidably mounted in a vertical support frame; and this vertical support frame is in turn securily affixed to one end of a horizontal slide member. This horizontal slide member and the vertical staff member are further secured, one to another, by means of a handle which is affixed at one end to the top of the staff member and affixed at its other end to the other end of the slide member. The staff member includes a plurality of precisely spaced passages therein adapted to receive a marking member, such as a felt-tip pen. Once the felt-tip pen or other suitable marking member is inserted into a passage, a straight horizontal line may be rapidly drawn on a chalkboard or the like by sliding the horizontal slide member across a chalkboard chalk tray. During this movement, the pen is urged gently against the chalkboard as a result of the staff member leaning slightly against the chalkboard.

10 Claims, 7 Drawing Figures

FIG. 1
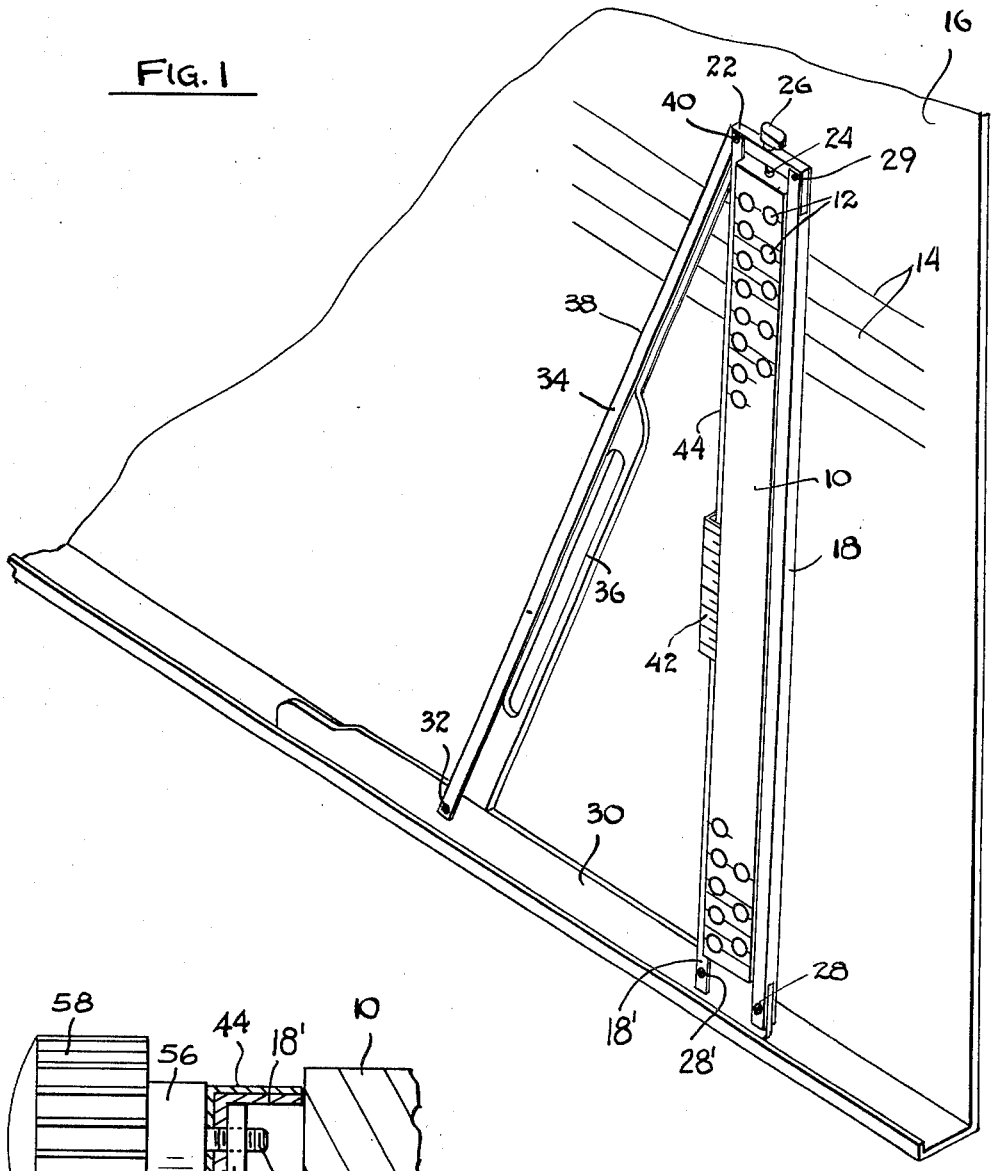
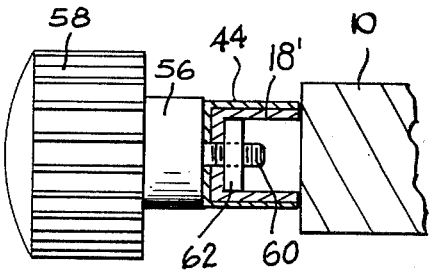
FIG. 3E
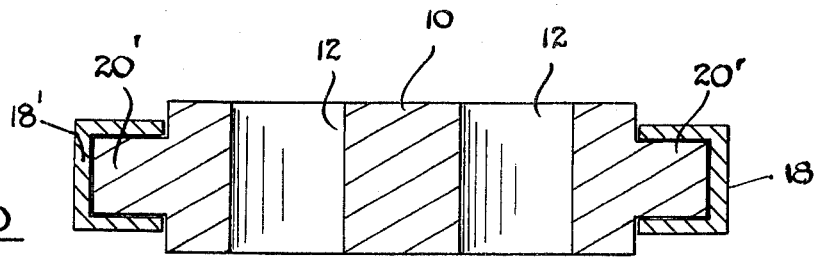
FIG. 3D

CHALKBOARD LINE TOOL

FIELD OF THE INVENTION

This invention relates generally to straight line rulers and more particularly to a slidable and positionally adjustable chalkboard ruler for use in rapidly making a plurality of precisely spaced, parallel lines horizontally across a chalkboard or the like. The construction of this tool is fantastically simple, and thus maximizes the functions of each member thereof.

BACKGROUND

In recent years, the felt-tip marking pens have been sometimes used to make permanent or semi-permanent reference lines on a chalkboard in place of ordinary erasable white or yellow chalk lines. These lines are useful, of course, for assisting school teachers in writing and printing good upper and lower case letters on a classroom chalkboard. There was, of course, a time when ordinary white or yellow chalk sticks were used, day after day, in the repeated exercise of drawing horizontal lines on a chalkboard for subsequent use in writing and printing these upper and lower case letters. But the manufacture of the felt-tip marker pen in a variety of colors has permitted the more recent use of a more durable or semi-permanent reference lines on the chalkboard, as well as the use of such lines in relatively dark colors which tend to blend into the black background color of the chalkboard. Such horizontal lines therefore do not (visually) significantly interrupt the vertical lettering drawn across these lines when this lettering is viewed from a certain distance away from the chalkboard.

PRIOR ART

To the best of my knowledge, there is not available presently, nor has there ever been available at any time in the past, a commercially satisfactory chalkboard line tool particularly adapted for the rapid marking of a plurality of parallel horizontal lines on a chalkboard. Furthermore, I know of no such line tool which is particularly adapted for use with modern day felt-tip pens, so that these pens can be used for rapidly drawing relatively dark semi-permanent reference lines on a chalkboard. I have conducted a prior art search in the U.S. Patent Office in an effort to uncover any art relevant to my invention, and such prior art search revealed U.S. Pat. Nos. which are numbered as follows: 125,763; 668,957; 509,356; 858,254; 561,585; 1,186,716; 621,064; 3,086,290.

The above references have been carefully considered, and none of these references, nor any other prior art known to me, teach a chalkboard line tool of simple and economical construction and which is operative to permit the rapid and easy production of a large plurality of horizontal parallel lines on a chalkboard with a minimum of effort by the person using the tool. On the contrary, most if not all of the above references are relatively complicated in their construction and require moving parts, or both. Furthermore, these references do not permit the rapid vertical positioning and adjustment of a marking member, such as a felt-tip pen, in preparation for direct marking contact with a chalkboard.

THE INVENTION

The general purpose of this invention is to provide a new and improved chalkboard line tool of simple, economical, and reliable construction and which is useful to enable the rapid drawing of a large plurality of selectively spaced parallel horizontal lines on a chalkboard with a minimum of effort by the user, e.g., a classroom teacher. To accomplish this purpose, I have constructed a chalkboard line tool which includes a marker positioning staff member having a plurality of precisely spaced passages therein, each of which is adapted to receive a chalkboard marker, such as a felt-tip pen. The staff member is slidably mounted in a vertical frame member which in turn is securely affixed to one end of a tool slide member. The above staff member is multifunctional in that it provides both support, location, and adjustment for the marker members inserted therein. The slide member is also multifunctional in that it provides both support for the marker positioning staff member and a means for sliding the marker members in straight horizontal lines across a chalkboard.

An angularly positioned handle member is secured at one end thereof to the top of the vertical frame member and at the other end thereof to the other end of the slide member. The handle member is also multifunctional in that it provides a means for pulling the line tool across the chalk tray of chalkboard and it also provides additional and rigid support between the mutually perpendicular slide and staff members previously described. In operation, a classroom teacher may rapidly position and then reposition a chalkboard marker, such as a felt-tip pen, in successive openings in the marker positioning staff member in the process of making horizontal lines on a chalkboard. Additionally, the vertical adjustment of the staff member is accomplished by means of a vertical rod which is threaded into the top of the staff member and supported by a rotatable knob on top of the vertical frame member.

OBJECTS AND FEATURES

Accordingly, an object of the present invention is to provide a new and improved chalkboard line tool which is useful for rapidly drawing parallel horizontal lines on a chalkboard or the like.

Another object is to provide a chalkboard line tool of the type described wherein each member of the tool is multifunctional and thereby greatly simplifies the overall construction of the tool.

Another object is to provide a chalkboard line tool of the type described whose simplified construction insures enhanced reliability and durability in operation and a long operational life.

One feature of the present invention is the provision of a vertically adjustable, marker positioning staff member which is readily accessible to an operator for insertion and reinsertion of a chalkboard marker into any one of a plurality of passages therein.

Another feature of this invention is the provision of a line locating member which is slidably mounted on the vertical frame member of the tool. The line locating member may be easily positioned by an operator at either the beginning or the end of a slide movement used to make a horizontal line, thereby enhancing the rapidity with which the selection of passages in the staff member can be made for each horizontal line drawn.

A further feature of this invention is the provision of a horizontal slide member for the chalkboard line tool which is of one piece construction and requires no moving parts. This slide member lends itself to substantial variability in suitable materials which may be used in its fabrication.

These and other objects and features of this invention will become more readily apparent in the following description of the accompanying drawings wherein:

DRAWINGS

FIG. 1 is a perspective view of the chalkboard line tool resting in the chalk tray of a blackboard or the like.

Figures 2, 3A, 3B, 3C:
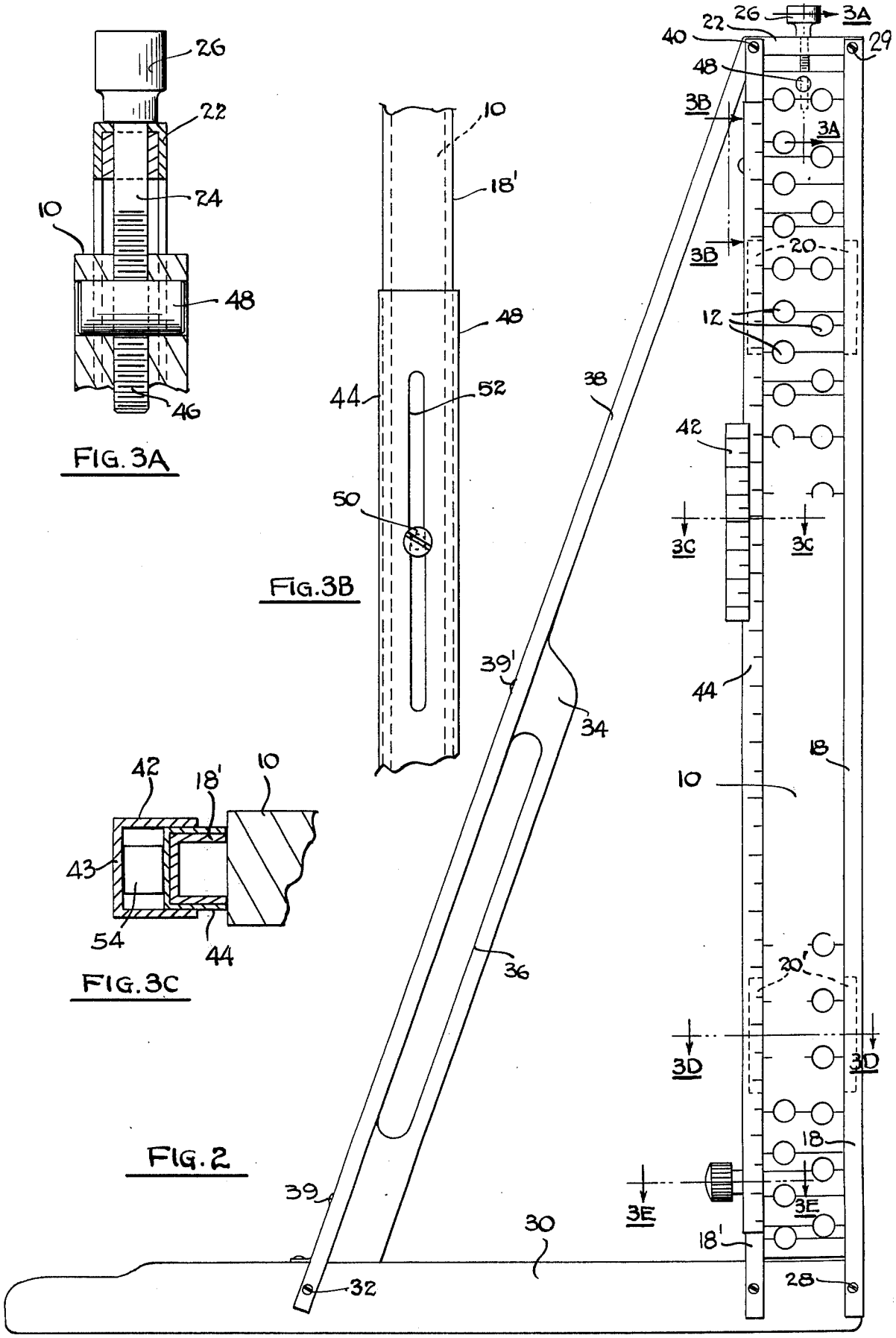
FIG. 2 is an elevation view of the chalkboard line tool according to the invention.

FIGS. 3*a* through 3*e* are enlarged, partially sectioned views taken along lines *a—a* through *e—e* of FIG. 2 respectively.

Referring now to FIG. 1, there is shown a vertical, marker positioning staff member 10 having a plurality of passages 12 extending therethrough between the opposed major surfaces of the member 10. These openings are adapted to receive a chalkboard marker, such as a felt-tip pen, for drawing a plurality of straight horizontal lines 14 on a chalkboard 16 or the like. The staff member 10 is slidably mounted in a vertical frame member which includes individual frame pieces 18 and 18'. As will be seen in more detail hereinafter, the staff member 10 has a plurality of protruding sliders 20 (see FIG. 2) which are received in sliding relationship by the interior walls or races of the vertical frame pieces 18 and 18'.

The vertical frame member further includes a top cross piece 22 secured to the top ends of the vertical frame pieces 18, 18', and cross piece 22 has an opening therein for receiving an adjustment screw 24 which is threaded into the top wall of the staff member 10. The screw 24 has a knob member 26 thereon for turning the screw 24 in the staff member 10 to thereby raise or lower the staff member 10 prior to drawing a horizontal line 14 on the board 16. The vertical frame pieces 18 and 18' are further secured at their lower ends respectively by a pair of screws 28 and 28' to the righthand end of a slide member 30.

The slide member 30 is secured by a screw 32 to the lower end of a handle frame member 34, and the upper end of the handle frame member 34 is secured to the vertical frame piece 18' by means of a screw 40. The handle 36 itself with the elongated opening therein is secured to the handle frame member 34 by means of a pair of screws 39 and 39' better seen in FIG. 2.

A vertical ruler 44 slidably engages the inner vertical frame piece 18', and this vertical ruler 44 is used to position the vertical staff member 10 initially with respect to some predetermined location on the blackboard 16. For example, if the top of the vertical ruler 44 is aligned with the top of the blackboard 16 (or any other reference point thereon), then the vertical ruler 44 could be used to insure that the initial opening 12 used for making a horizontal line is spaced a predetermined distance from the top of the board 16 or a predetermined distance from any other reference line thereon. However, in normal classroom use, the vertical ruler 44 will find little actual use in day-to-day operation of the tool.

A line locator 42 fits snuggly over the vertical ruler 44 and may be utilized either before or after a line is drawn as an easy and convenient means to change the position of the staff member 10 by a predetermined distance. For example, suppose a particular distance between the previously drawn line and the next line is required. By using the line locator 42 and positioning the top thereof in alignment with the previously drawn line, the adjustment screw 24 can be used to shift the openings 12 in the staff member by said predetermined distance as read directly on the line locating member 42. Advantageously, the indicia spacings on the line locator 42 can correspond directly to the center-to-center spacings of the openings 12 in the staff member 10. Advantageously, the spacings between openings down the lefthand side of the staff member is 1½ inches, whereas the spacings between openings down the righthand side of the staff member is two inches. On the other hand, these spacings can be converted to 4 and 5 centimeters respectively, and both the spacings between openings 12 and the indicia on both the vertical ruler 44 and line locator 42 can be referenced to the metric system if desired.

Before describing in detail some of the individual novel structural features of the line tool, it should be noted that the staff member 10 may be easily removed from the structure described merely by the removal of screws 28' and 29 in the vertical frame piece 18'. Thus, the line tool according to the invention lends itself to the ease of replacement with another staff member having openings with different spacings which may be required for another particular set of horizontal lines.

Referring now in more detail in FIGS. 2 and 3A through 3E, there is shown in the enlarged elevation view of FIG. 3A the precise technique used for raising and lowering the staff member 10. The threaded screw 24 is received by a cylindrical nut 48 located within the top section of the staff member 10. Thus, the nut 48 remains stationary as the threads 46 move through the nut 48 to in turn raise and lower the staff member 10.

Referring now to FIG. 3B there is shown in greater detail the vertical or starting rule member 44 which, as mentioned earlier, fits snuggly over the inner vertical frame piece 18. The inner vertical frame piece 18 fits snuggly over the protrusions 20 of the staff member 10, and the starting rule 44 is maintained in a fixed position on the inner vertical frame member 18' by means of a screw 50 which fits through the elongated slot 52 in the vertical starting rule 44. Thus, the screw 50 may be loosened and the vertical rule 44 moved vertically upward or downward along the inner frame piece 18' while being retained on the frame member 18' and not allowed to fall away therefrom.

Referring now to FIG. 3C, the line locator 42 has its inside wall 43 separated from the outside wall of the starting rule 44 by means of a magnet 54. The magnet 54 is securely bonded to the inside wall 43 of the line locator 42, and this magnet 54 thus allows the line locator 42 to be easily set at any desired position along the starting rule 44. The indicia on the line locator 42 can be easily aligned with the passages 12 in the frame member 10, and these passages may then be easily moved up or down the line locator 42 by a predetermined amount in order to rapidly shift the position of the passages 12.

Referring now to FIG. 3D, there is shown in more detail the protruding slide members 20' which extend from each side of the staff member 10 into slidable engagement with the inner race of the vertical frame pieces 18 and 18'. By using individual protruding slide members 20', it is not necessary that the entire length of the staff member 10 be used for slide purposes. These slide members 20 and 20' quite adequately retain the staff member 10 in a fixed position once the adjustment screw 24 has been set.

Referring now to FIG. 3E, there is shown a starting rule position set screw 56 having a rotatable knob 58 as shown for turning the protruding screw 60 through the vertically positioned nut 62 in order to clamp the vertical starting rule 44 tightly against the inner frame piece 18'. Therefore, by loosening the screw 56 and also by loosening the screw 50 in FIG. 3B, the starting or vertical rule 44 may be initially positioned with respect to a particular position or point on the blackboard 16. Thereafter, screws 50 and 56 may be tightened to firmly clamp the starting rule 44 to the inner vertical frame piece 18'.

There has been described an extremely useful chalkboard line tool of rugged and economical construction and which maximizes the function of the individual members of the tool while not relying on moving parts during the sliding of the tool across the length of a blackboard chalk tray. The tool has no rollers, bearings or the like, and the only movement involved is that required to slide frame pieces 18, 18' against fitting slide pieces 20, 20°, whereafter set-in-position screws are tightened and the tool is ready for use. In the case of the line locator 42, there are no screws required because of the use of the magnet 54.

It should be understood that the above described invention is not limited by any particular materials used to construct the slide member 30, the staff member 10 or the handle member 34, and any materials such as wood, plastic, or even metal may be used for making these piece parts of the line tool apparatus. Advantageously, the metal frame pieces 18, 18' and 34 may be selected from any one of a variety of cast metals which are not subject to any permanent bending with tool use.

Various other modifications may be made in the construction of my line tool without departing from the true spirit and scope of this invention. For example, if for some reason no vertical adjustment of the staff member 10 was required, then the vertical pieces 18 and 18' could be entirely eliminated, and the staff member 10 correspondingly modified so that the lower end of the member 10 was securely fixed directly to the righthand end of the slide member 30 and the upper end of the staff member 10 securely affixed directly to the upper end of the angularly positioned handle frame 34. Therefore, it should be clearly understood that the use of the vertical staff member 10 with passages 12 extending between major faces of the member 10, may be used in other configurations with the handle means and slide means of the invention without requiring the specific vertical frame pieces 18 and 18' as previously described. Such proposed modification would clearly be within the scope of the present invention.

What is claimed is:

1. A tool for use in drawing parallel horizontal lines on a chalkboard or the like, including, in combination:

a. staff means including spaced apart major surfaces and a plurality of selectively spaced passages extending between said major surfaces for receiving marker pens or the like substantially perpendicular to said major surfaces, whereby a marker pen will contact said chalkboard as one of said major surfaces leans theretoward, b. slide means rigidly coupled to one end of said staff means and having a lower edge adapted for sliding in a blackboard chalk tray, wherein said slide means and said staff means are secured one to another, by means of a vertical frame member which is secured at one end thereof to said slide means, c. said staff means slidably engaging said vertical frame member to allow for the adjustable positioning of said staff means relative to said frame member prior to drawing lines on a chalkboard, d. a vertical adjustment screw disposed through an opening in said frame member and threadably engaged to said staff means for raising or lowering said staff means prior to drawing lines on a chalkboard, and e. handle means rigidly coupled between a selected location on said slide means and a selected location on said staff means, whereby the simplicity of tool construction is achieved by maximizing the function of each of said staff means, said slide means, and said handle means.

2. The tool defined in claim 1 wherein said passages are cylindrical for receiving a felt-tip marking pen.

3. The tool defined in claim 1 wherein said passages are cylindrical for receiving any type of cylindrical marker with the longitudinal axis of said marker being substantially perpendicular to the chalkboard on which lines are drawn, and said passages being staggered and spaced predetermined distances apart along the length of said staff means.

4. The tool defined in claim 1 wherein a. said vertical frame member includes a pair of vertical frame pieces secured at spaced apart locations on said slide means and having inner races for slidably receiving said staff means, and b. said vertical frame member further including a cross-frame piece at the top portion thereof rigidly secured between top ends of said vertical frame pieces, and c. said a vertical adjustment screw disposed through an opening in said cross-frame piece and threadably engaged to said staff means for raising or lowering said staff means prior to drawing lines on a chalkboard.

5. The tool defined in claim 4 wherein said handle means include:

a. an angularly positioned frame piece secured at one end at a selected location on said slide means and secured at the other end to a selected location on one of said vertical frame pieces, said angularly positioned frame piece having an inner race for receiving a handle member, and b. a handle member securely fixed at a selected location on said inner race of said angularly positioned frame piece and having an elongated opening therein into which an operator may readily place his hand for pulling the tool across the length of a chalk tray of a blackboard.

6. The tool defined in claim 5 wherein said passages are cylindrical for receiving a felt-tip marking pen.

7. The tool defined in claim 5 wherein said passages are cylindrical for receiving any type of cylindrical marker with the longitudinal axis of said marker being substantially perpendicular to the chalkboard on which lines are drawn, and said passages being staggered and spaced predetermined distances apart along the length of said staff means.

8. The tool defined in claim 5 which further includes a plurality of protruding slide members integrally formed with said frame means and extending away from said major surfaces thereof into slidable engagement with the races of said vertical frame member.

9. The tool defined in claim 5 which further includes a starting rule member adjustably positioned at a selected location on said vertical frame member for indicating to an operator the first passage used in marking a horizontal line on a chalkboard.

10. The tool defined in claim 5 which further includes a vertical ruler mounted on one of said vertical frame pieces and a position set screw extending between concentric openings in said vertical ruler and one of said vertical frame pieces for setting the position of said vertical ruler on said vertical frame piece during the use of said tool.

* * * * *